US005927076A

United States Patent [19]

Pillsbury

[11] Patent Number: 5,927,076

[45] Date of Patent: Jul. 27, 1999

[54] MULTIPLE VENTURI ULTRA-LOW NOX COMBUSTOR

[75] Inventor: Paul W. Pillsbury, Winter Springs, Fla.

[73] Assignee: Westinghouse Electric Corporation, Pittsburgh, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/734,895

[22] Filed: Oct. 22, 1996

[51] Int. Cl.[6] ..... F02C 7/08

[52] U.S. Cl. ..... 60/738; 60/733; 60/737; 60/749

[58] Field of Search ..... 60/733, 737, 738, 60/739, 740, 746, 749

[56] References Cited

U.S. PATENT DOCUMENTS

| | | | |
|---|---|---|---|
| 2,979,900 | 4/1961 | Hopper | 60/749 |
| 4,003,201 | 1/1977 | Lewis et al. | 60/749 |
| 4,356,698 | 11/1982 | Chamberlain | 60/733 |
| 5,054,280 | 10/1991 | Ishibashi et al. | 60/733 |
| 5,148,667 | 9/1992 | Morey . | |
| 5,235,814 | 8/1993 | Leonard | 60/738 |
| 5,285,632 | 2/1994 | Halila . | |
| 5,323,614 | 6/1994 | Tsukahara et al. | 60/737 |
| 5,359,847 | 11/1994 | Pillsbury et al. . | |
| 5,452,574 | 9/1995 | Cowell et al. . | |
| 5,558,515 | 9/1996 | Althaus et al. . | |
| 5,660,045 | 8/1997 | Ito et al. . | |

FOREIGN PATENT DOCUMENTS

| | | |
|---|---|---|
| 445652 | 9/1991 | European Pat. Off. . |
| 473371 | 3/1992 | European Pat. Off. . |
| 0488557 | 6/1992 | European Pat. Off. . |
| 709452 | 5/1954 | United Kingdom . |

OTHER PUBLICATIONS

Tacina, "Low $No_x$ Potential Of Gas Turbine Engines", NASA Lewis Research Center, Cleveland OH, 28th Aerospace Sciences Meeting, Jan. 8–11, 1990, Reno, Nevada.

Anderson, "Effect Of Premixing On Nitric Oxide Formation", NASA Technical Memorandum, NASA TM X–68220, Technical Paper presented at 75th National Meeting of American Institute of Chemical Engineers, Detroit Michigan, Jun. 3–6, 1973.

Tacina, "Degree of Vaporization Using An Airblast Type Injector For A Premixed—Prevaporized", Technical Paper presented at First International Conference on Liquid Atomization and Spray Systems sponsored by the Fuel Society of Japan, Tokyo, Japan, Aug. 28–31, 1978.

Tacina, "Experimental Evaluation Of Fuel Preparation Systems For An Automotive Gas Turbine Catalytic Combustor", Technical Paper presented at the Second Workshop on Catalytic Combustion sponsored by the Environmental Protection Agency, Raleigh, North Carolina, Jun. 21–22, 1977.

*Primary Examiner*—Charles G. Freay

[57] ABSTRACT

An ultra-low NOx gas turbine combustor having a dual fuel capability. The combustor has a plurality of venturis in flow communication with a corresponding number of fuel lances such that fuel injected from each lance into a corresponding venturi is mixed with high velocity air also flowing into the venturis. A vee-gutter flame holder is positioned downstream of the array of venturis for holding a combustion flame within the combustor at stable conditions. Due to the high velocities of the air-fuel mixture in the vicinity of the flame-holder, as a result of the fuel-air mixing in the venturis, destructive flash back conditions are obviated. A stable flame within the combustor provides for minimum acoustic disturbance and low overall pressure losses within the combustor provide for high operating efficiency levels of the turbine apparatus. Burning of the fuel in air at lean mixtures allows for minimal operation of a conventional pilot nozzle assembly so as to reduce the undesirable formation of NOx.

8 Claims, 2 Drawing Sheets

MULTIPLE VENTURI ULTRA-LOW NOX COMBUSTOR

BACKGROUND OF THE INVENTION

The present invention relates to a combustor capable of burning fuel in compressed air. More specifically, the present invention relates to a combustor for a gas turbine having venturi fuel-air mixing apparatus and flame stabilization apparatus such that the combustor operates at ultra-low NOx conditions with a stable flame in the combustion zone.

In a gas turbine, fuel is burned in compressed air, produced by a compressor, in one or more combustors. Traditionally, such combustors had a primary combustion zone in which an approximately stoichiometric mixture of fuel and air was formed and burned in a diffusion type combustion process. Although the overall fuel/air ratio was considerably less than stoichiometric, the fuel/air mixture was readily ignited at start-up and good flame stability was achieved over a wide range in firing temperatures due to the locally richer nature of the fuel/air mixture in the primary combustion zone.

Unfortunately, use of such approximately stoichiometric fuel/air mixtures resulted in very high temperatures in the primary combustion zone. High temperatures in the primary combustion zone promote the formation of NOx, considered an atmospheric pollutant.

It is known that NOx formation can be reduced by combustion at lean fuel/air ratios. Such lean burning, however, requires that the fuel be well distributed throughout the combustion air without creating any locally rich zones. Unfortunately, in known combustor arrangements designed to provide lean fuel/air mixtures, air is delivered to the flame-front at the time of combustion at an undesirably low velocity. Burning of the fuel at a low flame velocity is known to cause the flame to travel back upstream ahead of the desired location of the flame-front. Accordingly, fuel at locations upstream of the desired flame-front becomes ignited in low velocity air in a flash-back condition. Flash-back conditions within the combustor are known to increase the formation of NOx beyond acceptable levels, reduce the overall turbine operating efficiency to undesirable levels and result in prolonged destruction of the combustor apparatus.

It is therefore desirable to provide a combustor that is capable of burning fuel at very lean mixtures of fuel and air and wherein the fuel is burned in air at a velocity that is sufficiently high to avoid flashback, so as to reduce the formation of NOx and provide for stable combustion.

SUMMARY OF THE INVENTION

Accordingly, it is the general object of the current invention to provide a combustor that is capable of burning fuel at very lean mixtures of fuel and air and wherein the fuel is burned in air that is at a velocity that is sufficiently high to avoid flashback, so as to reduce the formation of NOx and provide for stable combustion.

Briefly, this object, as well as other objects of the current invention, is accomplished in a gas turbine, comprising (a) a compressor for compressing air, (b) a combustor for producing a hot gas by burning a fuel in the compressed air, and (c) a turbine for expanding the hot gas produced by the combustor. According to one embodiment of the invention, the combustor has (I) a combustion zone, (ii) a centrally disposed first fuel nozzle, (iii) a plurality of second fuel nozzles circumferentially distributed around the first fuel nozzle, (iv) a plurality of venturis in flow communication with the compressed air and the combustion zone, the plurality of venturis corresponding in number to the number of second fuel nozzles, each one of the second fuel nozzles being in flow communication with a corresponding one of the venturis for introducing a fuel into the venturis; and (v) one or more flame holders disposed proximate the plurality of venturis.

DESCRIPTION OF THE PREFERRED EMBODIMENT

Operation of a gas turbine system, and particularly the combustion section of the turbine system, is set forth in my U.S. Pat. No. 5,359,847—Pillsbury et al., assigned to Westinghouse Electric Corporation, which is herein incorporated by reference as if set forth in its entirety.

Figure 1:
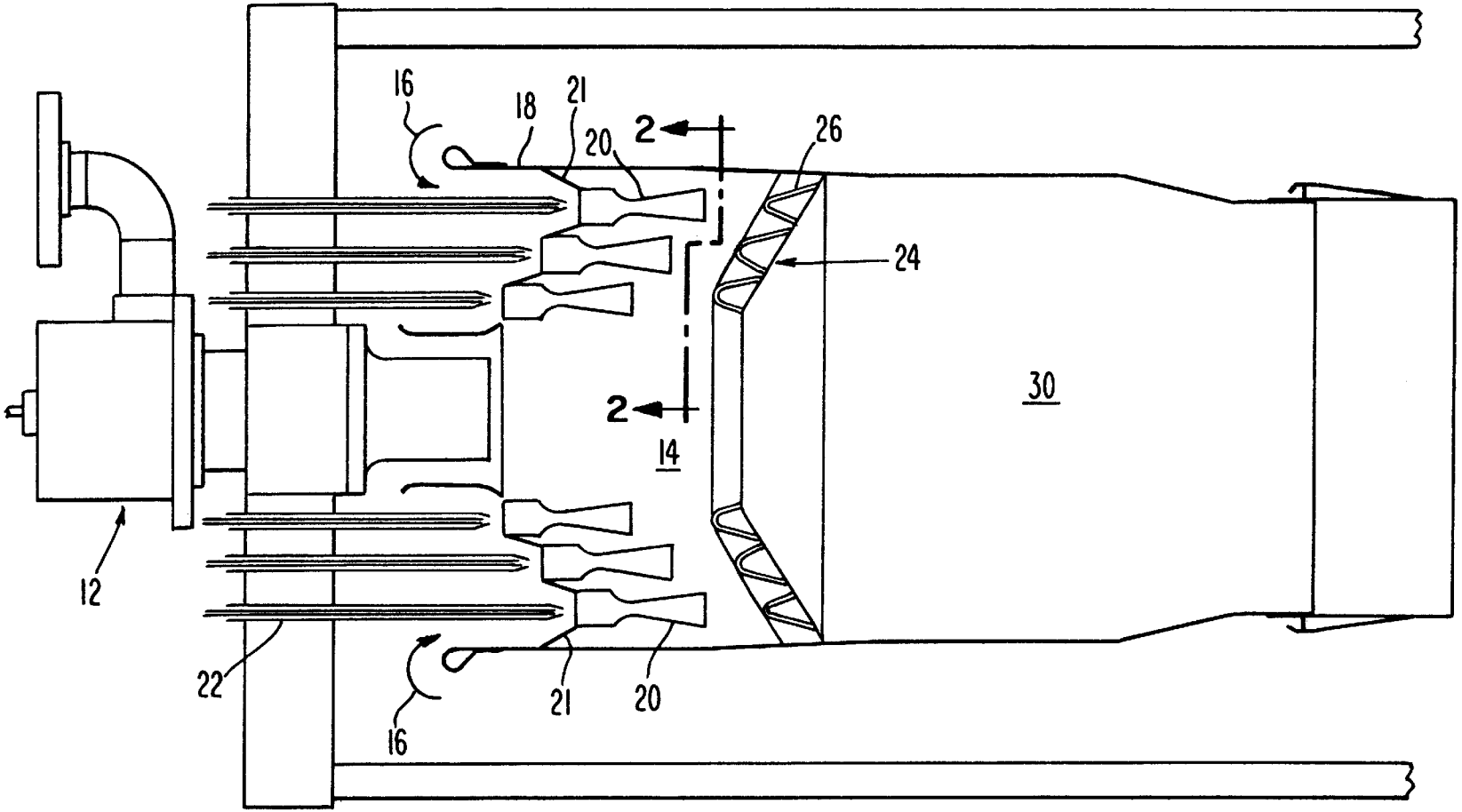
FIG. 1 is a longitudinal cross-section of a combustor in accordance with the invention.

Referring to FIG. 1, a combustor 10 has a pilot fuel nozzle assembly 12. For light off of the combustor, a small amount of fuel is delivered to the pilot nozzle assembly 12 from a fuel supply (not shown). Fuel is then injected by the pilot nozzle assembly 12 into a pilot zone 14. Fuel from the pilot nozzle assembly is ignited electrically in the pilot zone 14 in a known manner such that a flame is established in the pilot zone. The flame is maintained in the pilot zone by the burning of fuel injected from the pilot nozzle assembly into the pilot zone.

Figure 2:
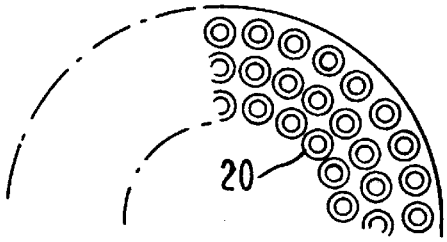
FIG. 2 is a partial view along lines 2—2 of FIG. 1 of an array of venturis in accordance with the invention.

Compressed air 16 from the compressor section of the turbine flows around the exterior walls 18 of the combustor 10 and enters the interior head of the combustor. Thereafter, the air flows into a plurality of venturis 20 arranged in an annular array around the combustor central axis. Referring to FIGS. 1 and 2, the venturis are preferably arranged in three concentric annular arrays around the combustor central axis, proximate the exterior walls of the combustor. In a preferred embodiment the combustor is fitted with 80 venturis.

A plurality of fuel lances 22, corresponding in number to the number of venturis 20, are arranged in an annular array around the combustor central axis. Each fuel lance 22 is in flow communication with a supply of fuel (not shown). The fuel lances are arranged in an annular array in a manner similar to the arrangement of the venturis, such that the tip of the each fuel lance 22 is in flow communication with the inlet of a corresponding venturi 20.

Fuel is injected from each of the fuel lances 22 into a corresponding venturi 20. As described in U.S. Pat. No. 5,359,847, in a preferred embodiment the fuel lances can deliver liquid oil or gas fuel, or both, to the venturis. The fuel injector lances have concentric tubes for delivering the fuel, with oil being conveyed in an inner tube and gas, when desired, being delivered from an outer tube. Sleeves 21 seal the spaces between the venturis 20, as well as between the outermost circle of venturis and the exterior wall 18 of the combustor, to assure that substantially all of the combustion air 16 flows into the venturis. A small gap can be provided between the innermost circle of venturis and the end of the pilot nozzle assembly 12 to provide for expansion and contraction of the components.

When the fuel is injected into the venturis by the fuel lances the fuel mixes with the combustion air from the compressor section also flowing into the venturis. When the fuel reaches the throat of the venturis it becomes very well mixed with the air, due to the high velocity of the air in this zone. When liquid fuel is injected into the venturis the velocity of the air in the venturis atomizes the fuel droplets to provide substantially high levels of mixture of the fuel into the air for combustion.

Figure 3A:
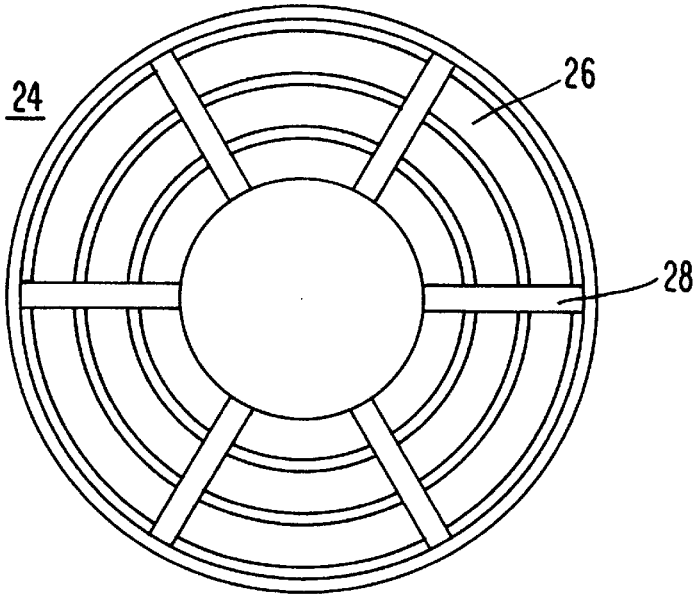
FIGS. 3A and 3B are upstream and donwstream views, respectively, of a vee-gutter flameholder in accordance with the invention.
Figure 3B:
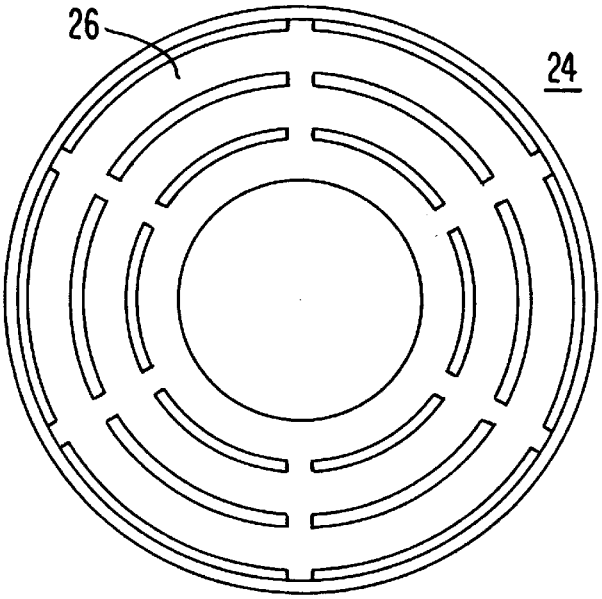

After the light-off sequence for the combustor, when a flame has been well established in the pilot zone, the fuel is injected from the fuel lances to the venturis in the manner described. The flow of the fuel-air mixture exiting the venturis proceeds downstream to the vicinity of a vee-gutter flame holder array 24 located proximate the outlet of the venturis, as shown in FIGS. 1 and 3A and 3B. The vee-gutter flame holder comprises three continuous annular channels 26 joined at several locations by ridge-like interconnectors 28. The flame holder array is preferably made of a double-wall construction. The flame holder array can be cooled by internal flows of air or steam in the combustor.

As the fuel-air mixture exits the venturis and flows into the vicinity of the flame holder 24, the fuel is ignited by the flame from the pilot zone 14 established during the described light-off sequence. The flame of the fuel that has exited the venturis is distributed radially around the flame holder 24 by the interconnectors 28 and is held in the vee-gutter channels. A combustion flame is established in a main combustion zone 30 downstream of the flame holder for burning of the fuel. Once the flame has been established in the main combustion zone 30, the fuel supply to the conventional pilot nozzle assembly 12 can be decreased so as to provide for a leaner fuel-air ratio in order to reduce the NOx emissions.

The combustor internal air velocities in the venturis and upstream, and around, the flameholders is too high for the flame to travel upstream to cause a destructive flash back condition. Moreover, the flame is stabilized in the low velocity, recirculation zones downstream of the flameholders. Because the flame is stabilized in a stationary location, acoustic pulses resulting from high-speed motions of the flame front are obviated. Also, the overall operating efficiency of the combustors is improved due to a low overall pressure loss within the combustor.

The present invention may be embodied in other specific forms without departing from the spirit or essential attributes thereof and, accordingly, reference should be made to the appended claims, rather than to the foregoing specification, as indicating the scope of the invention.

I claim:

1. A gas turbine, comprising:

a) a compressor for compressing air;

b) a combustor for producing a hot gas by burning a fuel in said compressed air, said combustor having:

(I) a combustion zone, (ii) a centrally disposed first fuel nozzle, (iii) a plurality of second fuel nozzles circumferentially distributed around said first fuel nozzle, (iv) a plurality of venturis in flow communication with said compressed air and said combustion zone, said plurality of venturis corresponding in number to the number of said plurality of second fuel nozzles, each one of said second fuel nozzles being in flow communication with a corresponding one of said venturis for introducing a fuel into said venturis, (v) one or more flame holders disposed proximate said plurality of venturis; and c) a turbine for expanding said hot gas produced by said combustor.

2. The gas turbine according to claim 1, wherein each said one or more flame holders comprises a continuous annular ring.

3. The gas turbine according to claim 2, wherein said combustor has three V-gutter flame holders.

4. The gas turbine according to claim 3, wherein said V-gutter flame holders are mechanically coupled to one or more interconnectors for distributing flame in a radial direction with respect to said V-gutter flame holders.

5. The gas turbine according to claim 1, said combustor having eighty second fuel nozzles and eighty venturis.

6. The gas turbine according to claim 1, said second fuel nozzles being in flow communication with a supply of liquid fuel.

7. The gas turbine according to claim 6, said second fuel nozzles being in flow communication with a supply of gas fuel.

8. The gas turbine according to claim 1, said venturis being arranged in three annular rings.

* * * * *